US008470405B2

(12) United States Patent
Nakashima et al.

(10) Patent No.: US 8,470,405 B2
(45) Date of Patent: Jun. 25, 2013

(54) METHOD OF FORMING MULTI-LAYER PAINT FILMS

(75) Inventors: Hisayuki Nakashima, Kanagawa (JP); Souichi Mori, Kanagawa (JP); Satoshi Matsumoto, Kanagawa (JP); Daiki Fujihira, Kanagawa (JP)

(73) Assignee: BASF Coatings Japan Ltd. (JP)

( * ) Notice: Subject to any disclaimer, the term of this patent is extended or adjusted under 35 U.S.C. 154(b) by 359 days.

(21) Appl. No.: 12/672,766

(22) PCT Filed: Jun. 25, 2008

(86) PCT No.: PCT/IB2008/001712

§ 371 (c)(1),
(2), (4) Date: Oct. 26, 2010

(87) PCT Pub. No.: WO2009/019547

PCT Pub. Date: Feb. 12, 2009

(65) Prior Publication Data

US 2011/0045192 A1 Feb. 24, 2011

(30) Foreign Application Priority Data

Aug. 7, 2007 (JP) ..... 2007-205940

(51) Int. Cl.
*B05D 3/02* (2006.01)

(52) U.S. Cl.
USPC ..... 427/407.1; 427/409

(58) Field of Classification Search
None
See application file for complete search history.

(56) References Cited

U.S. PATENT DOCUMENTS

| | | | | |
|---|---|---|---|---|
| 5,322,715 | A * | 6/1994 | Jouck et al. | 427/409 |
| 5,641,574 | A | 6/1997 | Kasari et al. | |
| 6,165,621 | A * | 12/2000 | Kasari et al. | 428/457 |
| 6,428,856 | B1 * | 8/2002 | Masuda et al. | 427/412.3 |
| 6,716,909 | B2 * | 4/2004 | Harakawa et al. | 524/591 |
| 8,034,877 | B2 * | 10/2011 | Adachi et al. | 525/124 |
| 2009/0041942 | A1 * | 2/2009 | Hayashi et al. | 427/385.5 |

FOREIGN PATENT DOCUMENTS

| | | | |
|---|---|---|---|
| EP | 1770135 | A1 | 4/2007 |
| EP | 1908807 | A1 | 4/2008 |
| JP | 2003064149 | A | 3/2003 |
| JP | 2004097917 | A | 4/2004 |
| JP | 2004337670 | A | 12/2004 |
| JP | 2004358462 | A | 12/2004 |
| WO | WO03/039767 | A1 | 5/2003 |
| WO | WO2007/013558 | A1 | 2/2007 |

OTHER PUBLICATIONS

International Search Report for International application No. PCT/IB2008/001712 dated Feb. 19, 2009.
Written Opinion for International application No. PCT/IB2008/001712 filed on Jun. 25, 2008.

* cited by examiner

*Primary Examiner* — Erma Cameron
(74) *Attorney, Agent, or Firm* — Cantor Colburn LLP

(57) ABSTRACT

To provide a method of forming a multi-layer paint film with which, even when applying three paint layers and baking the paint layer only once, it is possible to achieve a paint film appearance the same as that with the conventional baking twice method. [Means of Resolution] A method of forming a multi-layer paint film in which an aqueous first base-paint is painted on a base material on which an electro-deposition paint has been coated and a first base-paint layer is formed, an aqueous second base-paint is painted on said first base-paint layer as a wet-on-wet system and a second base-paint layer is formed and, moreover, a clear-paint is painted on the second base-paint layer as a wet-on-wet system and a clear-paint layer is formed and then the three paint layers are all baked at the same time which is characterized in that the aqueous first base-paint includes as essential components hydroxyl group containing non-ionic resin where ethylene oxide units and/or propylene oxide units are included in an amount of from 4 to 15 mass % in the resin and of which the resin acid value is less than 15 mgKOH/g and the hydroxyl group value is from 10 to 100 mgKOH/g, and crosslinking agent.

5 Claims, No Drawings

METHOD OF FORMING MULTI-LAYER PAINT FILMS

CROSS REFERENCE TO RELATED APPLICATIONS

This application is a National Phase Application of Patent Application PCT/EP2008/001712 filed on 25 Jun. 2008, which claims priority to JP 2007-205940, filed 7 Aug. 2007, both of which are hereby incorporated by reference in their entirety.

FIELD OF THE INVENTION

The present invention concerns a novel method of forming multi-layer paint films. More precisely, the invention concerns a method of forming multi-layer paint films which, even when in the automobile painting field in particular three paint layers are painted on and the paint layers are baked only once, provides the same paint film appearance as with the conventional two-bake process.

BACKGROUND OF THE INVENTION

Japanese Unexamined Patent Application Laid Open 2004-097917 discloses the method of forming a multi-layer paint film using an aqueous first colored paint (A), an aqueous second colored paint (B) and a clear paint (C) in which a paint film comprising three layers is obtained by means of a three-coat one-bake system comprising (1) a process in which the aqueous first colored paint (A) is applied, being a process in which an aqueous colored paint of solid fraction from 45 to 90 wt % of which the structural components include in 100 parts by weight of resin solid fraction comprising urethane emulsion (a) and other components (b) from 50 to 90 wt % of urethane emulsion (a) and from 10 to 50 parts by weight of other components (b), and in which from 10 to 200 parts by weight of pigment component (c) have been compounded, (2) a process in which setting is carried out at normal temperature and the paint film viscosity obtained by applying the aqueous first colored paint (A) is set to $1\times10^3$ Pa·sec (shear rate 0.1 $sec^{-1}$), (3) a process in which the aqueous second colored paint (B) of solid fraction from 15 to 50 wt % is applied, (4) a process in which preliminary heating is carried out and (5) a process in which the clear paint (C) is applied and the paint film comprising three layers is baked and dried simultaneously is known as a method of forming an aqueous 3C1B (three-coat one-bake) multi-layer paint film which has a good finish with no running, unevenness or layer-mixing. However with this method, at the time of the second layer application and in the preliminary heating process, dissolution and swelling of the first layer arise as a result of the water and amine material which is included in the second layer and there is a problem in that a satisfactory paint film appearance is not obtained.

Japanese Unexamined Patent Application Laid Open 2004-337670 provides a method for forming a multi-layer paint film in which an aqueous mid-coat paint (1), an aqueous base paint (2) and a clear paint (3) are applied sequentially in a wet-on-wet system and the multi-layer paint film obtained is baked and hardened all at the same time which is characterized in that the aforementioned aqueous mid-coat paint (1) includes an acrylic emulsion of average particle diameter from 0.05 to 10 μm, urethane emulsion of average particle diameter from 0.01 to 1 μm and hardening agent, the average particle diameter of the acrylic emulsion is the same as or greater than the average particle diameter of the urethane emulsion, and the particle number ratio of the acrylic emulsion/urethane emulsion is from 1/0.1 to 1/500 is known as a method in which, with a 3C1B painting system, the impact resistance and paint film appearance are improved using an aqueous paint for the mid-coat and the base. However, with this method the improvement in appearance is inadequate and there is a weakness in that the problem of wrinkling arises.

Japanese Unexamined Patent Application Laid Open 2004-358462 discloses a method for forming a multi-layer paint film which includes (1) a process in which there is provided an object which is to be painted on which an electro-deposited paint film has been formed; (2) a process in which an aqueous mid-coat paint is applied over the electro-deposited paint film and a mid-coat paint film is formed; (3) a process in which an aqueous base-paint and a clear paint are applied sequentially with a wet-on-wet system on the mid-coat paint without hardening the mid-coat paint and a base-paint film and a clear paint film are formed and (4) a process in which the mid-coat paint film, the base-paint film and the clear paint film are baked and hardened simultaneously which is characterized in that the mid-coat paint film which is formed from said aqueous mid-coat paint has a paint film water uptake of not more than 10% and a paint film water discharge rate of not more than 5%, and said aqueous mid-coat paint includes acrylic resin emulsion which has a glass transition temperature of from −50 to 20° C., an acid value of from 2 to 60 mgKOH/g and a hydroxyl group value of from 10 to 120 mgKOH/g, a urethane resin emulsion which has an acid value of from 5 to 50 mgKOH/g, and hardening agent, is known as a method of forming a multi-layer paint film with which mixing of the mid-coat paint film and the base-paint film is prevented effectively and which has excellent surface smoothness. However, with this method the mid-coat paint film is swelled by the amine which is included in the aqueous base-paint and so there is a weakness in that a satisfactory paint film appearance is not obtained.

Japanese Unexamined Patent Application Laid Open 2003-064149 provides a water dispersed polyisocyanate compositions which contain polyisocyanate (A) and polyurethane resin (B) which has nonionic groups in side chains are known as aqueous hardenable compositions which provide water dispersible polyisocyanate compositions which have excellent dispersibility in water, stability in respect of water and compatibility with aqueous resins which have active-hydrogen containing groups and have a long use time, and which have excellent hardening properties and provide hardened materials which have excellent appearance, water resistance and hardness (for example, see Patent Citation 4). However, here there is no description of a three-coat one-bake method of forming a multi-layer paint film, and with paints in which this composition is used there is a weakness in that the intended excellent paint film appearance cannot be obtained and also in that the storage stability is unsatisfactory.

Furthermore, International laid Open Specification WO 2003/039767 provides a method of forming a multi-layer paint film in which a cationic electro-deposition paint (a) is painted on the object which is to be painted, heated and hardened, then a water-based thermoplastic chip-resistant paint (b) is applied, after adjusting the solid fraction content in the paint film to 40% or above a water-based mid-coat paint (c) is applied, and the paint films of both the paint (b) and the paint (c) are heated and hardened and then the top-coat paint (d) is applied and hardened in which the water-based thermoplastic chipping-resistant paint (b) is a paint which includes a polyurethane emulsion which has been obtained by chain-extending a carboxyl group containing urethane pre-polymer in the presence of an aqueous medium and said polyurethane emulsion is an auto-emulsification type polyurethane emulsion which has been obtained mixing a urethane pre-polymer which has been obtained by reacting (i) aliphatic and/or alicyclic diisocyanate, (ii) polyether diol and/or polyester diol of number average molecular weight from 500 to 5000, (iii) low molecular weight polyhydroxyl compound and (iv) dimethylolalkanoic acid in proportions such that the NCO/OH equivalent ratio is within the range from 1.1 to 1.9 is water-extended and emulsified by mixing with water after or during neutralization with tertiary amine is known for a multi-layer paint film which has excellent chipping resistance and corrosion resistance (for example, see Patent Citation 5). However, with this composition baking is carried out after coating the aqueous mid-coat paint and there is a weakness in that the energy saving and more efficient painting operability which are the original aims of the three-coat one-bake multi-layer paint film forming method are inadequate.

SUMMARY OF THE INVENTION

The present invention provides a method of forming a multi-layer paint film which, even when three paint layers are applied and the paint layers are baked all at once, provides a paint film appearance the same as that with conventional two-bake processing and with which, moreover, paint films which have excellent water resistance and chipping resistance can be obtained.

As a result of thorough research carried out with a view to resolving the abovementioned problems, the inventors have discovered that the abovementioned problems can be resolved by means of a method of forming a multi-layer paint film in which an aqueous first base-paint which includes specified hydroxyl group containing resin which has specified contents of ethylene oxide units and/or propylene oxide units is painted on a base material on which an electro-deposition paint has been painted and a first base-paint layer is formed, an aqueous second base-paint is applied with a wet-on-wet system and a second base-paint layer is formed and, moreover, a clear paint is applied with a wet-on-wet system and then the three paint layers are baked at the same time, and the invention is based upon this discovery.

That is to say, the present invention provides a method of forming a multi-layer paint film in which an aqueous first base-paint is painted on a base material on which an electro-deposition paint has been coated and a first base-paint layer is formed, an aqueous second base-paint is painted on said first base-paint layer as a wet-on-wet system and a second base-paint layer is formed and, moreover, a clear-paint is painted on the second base-paint layer as a wet-on-wet system and a clear-paint layer is formed and then the three paint layers are all baked at the same time which is characterized in that the aqueous first base-paint includes as essential components hydroxyl group containing non-ionic resin where ethylene oxide units and/or propylene oxide units are included in an amount of from 4 to 15 mass % in the resin and of which the resin acid value is less than 15 mgKOH/g and the hydroxyl group value is from 10 to 100 mgKOH/g, and crosslinking agent.

Furthermore, the invention provides a method of forming a multi-layer paint film in which, in the abovementioned method of forming a multi-layer paint film, the aqueous first base-paint includes, as well as the aforementioned hydroxyl group containing non-ionic resin, hydroxyl group containing polyurethane resin and/or hydroxyl group containing polyester resin in a proportion of less than 50 mass % with respect to the total solid fraction of hydroxyl group containing resin including said hydroxyl group containing nonionic resin.

Furthermore, the invention provides a method of forming a multi-layer paint film in which, in the abovementioned methods of forming a multi-layer paint film, the hydroxyl group containing polyurethane resin which is used in the aqueous first base-paint is a water-dispersible type resin of hydroxyl group value from 10 to 100 mgKOH/g.

Furthermore, the invention provides a method of forming a multi-layer paint film in which, in the abovementioned methods of forming a multi-layer paint film, the hydroxyl group containing polyester resin which is used in the aqueous first base-paint is a water-dispersible type or water-soluble resin of hydroxyl group value from 10 to 150 mgKOH/g and acid value from 20 to 50 mgKOH/g.

Furthermore, the invention provides a method of forming a multi-layer paint film in which, in the abovementioned method of forming a multi-layer paint film, the crosslinking agent is melamine resin and/or blocked isocyanate compound, and the solid fraction mass ratio of the hydroxyl group containing resin and the crosslinking agent is from 40/60 to 80/20.

By using the method of forming a multi-layer paint film of this invention it is possible to provide a paint film appearance which is the same as that with a conventional two-bake process with a paint film which has been obtained by applying three paint layers and baking the paint layer only once. Furthermore, it is possible to form a paint film which has excellent water resistance and chipping resistance. The method of forming a multi-layer paint film of this invention is especially useful in the automobile painting field.

DETAILED DESCRIPTION OF THE INVENTION

The hydroxyl group containing nonionic resin which is used in the aqueous first base-paint of this invention is a resin which has a sufficient quantity of hydrophilic groups so that the resin can be dissolved or dispersed in water and which has hydroxyl groups for reacting with the crosslinking agent.

The hydroxyl group containing non-ionic resin includes essentially ethylene oxide units and/or propylene oxide units as hydrophilic groups. Furthermore, the hydroxyl group containing nonionic resin may have hydrophilic groups such as carboxyl groups, amino groups, methylol groups and the like as other hydrophilic groups.

The resin skeleton of the hydroxyl group containing non-ionic resin may be a resin such as a urethane resin, polyester resin, alkyd resin, epoxy resin or the like, but a polyester resin or polyurethane resin is preferred.

In those cases where the resin skeleton of the hydroxyl group containing nonionic resin is a polyester resin it can be obtained easily by means of a known esterification reaction using the polyhydric alcohols and polybasic acids from which polyester resins are usually constituted, and oils and fats as required, as the resin raw materials.

Examples of the aforementioned polyhydric alcohols include ethylene glycol, propylene glycol, 1,3-butylene glycol, 1,4-butandiol, 1,6-hexanediol, diethylene glycol, dipropylene glycol, neopentyl glycol, triethylene glycol, hydrogenated bisphenol A, glycerine, trimethylolethane, trimethylolpropane, pentaerythritol, dipentaerythritol and the like. Each of these polyhydric alcohols may be used individually, or two or more types may be combined.

Examples of the polybasic acids include phthalic anhydride, isophthalic acid, terephthalic acid, succinic acid anhydride, adipic acid, azeleic acid, sebacic acid, maleic acid anhydride, fumaric acid, itaconic acid, trimellitic acid anhydride and the like. Each of these polybasic acids may be used individually, or two or more types may be combined.

Examples of the oils and fats include soy bean oil, palm oil, safflower oil, rice bran oil, castor oil, tung oil, linseed oil, tall oil, and the fatty acids obtained therefrom.

Furthermore, in those cases where the resin skeleton of the hydroxyl group containing nonionic resin is a urethane resin it can be obtained by reacting polyol, polyisocyanate, polyamine and the like.

Polyester polyols, polyether polyols, acrylic polyols and the like, for example, can be cited as polyols, and these may be used individually on in the form of mixtures.

Furthermore, phenylene diisocyanate, tolylene diisocyanate, xylylene diisocyanate, bisphenylene diisocyanate, naphthylene diisocyanate, diphenylmethane diisocyanate, isophorone diisocyanate, cyclopentylene diisocyanate, cyclohexylene diisocyanate, methylcyclohexylene diisocyanate, dicyclohexylmethane diisocyanate, trimethylene diisocyanate, tetramethylene diisocyanate, pentamethylene diisocyanate, hexamethylene diisocyanate, propylene diisocyanate, ethylethylene diisocyanate, trimethylhexane diisocyanate and the like can be cited as the abovementioned polyisocyanate.

The introduction of the ethylene oxide units and/or propylene oxide units into the abovementioned hydroxyl group containing nonionic resin can be carried out, for example, by reacting with polyethylene oxide or polypropylene oxide of number average molecular weight from 300 to 3000, or with a mono-alkyl ether of polyethylene oxide or polypropylene oxide of number average molecular weight from 300 to 3000.

Said ethylene oxide units and/or propylene oxide units are included in the hydroxyl group containing nonionic resin in an amount of from 4 to 15 mass %, and preferably in an amount of from 5 to 12 mass. In those cases where there is less than 4 mass % the solubility or dispersion stability in water is lost and problems arise with resin aggregation. Furthermore, in those cases where the amount exceeds 15 mass % a reduction in the water resistance of the paint film arises.

Furthermore, in those cases where carboxyl groups are introduced into the abovementioned hydroxyl group containing nonionic resin the acid value is preferably less than 15 mgKOH/g, and more desirably less than 12 mgKOH/g. In those cases where it exceeds 15 mgKOH/g dissolution and swelling of the first base-paint layer occur when the aqueous second base-paint is applied and a problem arises in that the paint film appearance declines.

Said carboxyl groups are present to stabilize the hydroxyl group containing resin in water and so some or all of the carboxyl groups are preferably neutralized with a basic substance.

Ammonia, morpholine, N-alkylmorpholine, monoisopropanolamine, methylethanolamine, methylisopropanolamine, dimethylethanolamine, diisopropanolamine, diethanolamine, diethylethanolamine, triethanolamine, methylamine, ethylamine, propylamine, butylamine, 2-ethylhexylamine, dimethylamine, diethylamine, dipropylamine, dibutylamine, trimethylamine, triethylamine, triisopropylamine and tributylamine and the like can be cited as examples of the basic substance. One type of basic substance can be used, or two or more types can be used conjointly.

Furthermore, the number average molecular weight of the hydroxyl group containing nonionic resin is preferably from 500 to 20,000 and more desirably from 1,000 to 10,000. In those cases where it is less than 500 the chipping resistance performance is reduced, and in those cases where it exceeds 20,000 satisfactory flow properties are not obtained on baking and the appearance declines.

As well as the aforementioned hydroxyl group containing nonionic resin, hydroxyl group containing polyurethane resin and/or hydroxyl group containing polyester resin can be included in the aqueous first base-paint, and the proportion in which they are included, as resin solid fraction, is preferably less than 50 mass, and more desirably less than 40 mass %, with respect to the total amount of hydroxyl group containing resin solid fraction including the hydroxyl group containing nonionic resin.

In those cases where the hydroxyl group containing polyurethane resin and/or hydroxyl group containing polyester resin exceeds 50 mass % with respect to the total amount of hydroxyl group containing resin solid fraction including the hydroxyl group containing nonionic resin dissolution and swelling of the first base-paint layer arise and problems arise in that the paint film appearance declines.

In this invention the hydroxyl group containing polyurethane resins which can be included in the aqueous first base-paint can be obtained by reacting polyols and polyisocyanates, and the composition may be the same as, or different from, that of the urethane resin skeleton of the hydroxyl group containing nonionic resin.

The hydroxyl group containing polyurethane resin as a hydroxyl group value preferably of from 10 to 100 mgKOH/g and more desirably of from 20 to 80 mgKOH/g. In those cases where it is less than 10 mgKOH/g the emulsion stability of the resin in an aqueous medium is reduced, and in those cases where it exceeds 100 mgKOH/g the water resistance of the paint film is reduced.

The acid value of the hydroxyl group containing polyurethane resin is preferably from 10 to 50 mgKOH/g and more desirably from 20 to 50 mgKOH/g. In those cases where the acid value is less than 10 mgKOH/g the emulsion stability of the resin in an aqueous medium is reduced, and in those cases where it exceeds 50 mgKOH/g the water resistance of the paint film is reduced.

It is desirable that some or all of the carboxyl groups are neutralized with a basic substance so that the hydroxyl group containing polyurethane resin is present in a stable manner in water. The basic substance may be the same as, or different from, that used with the hydroxyl group containing nonionic resin. Furthermore, the number average molecular weight of the hydroxyl group containing polyurethane resin is preferably from 500 to 50,000, and more desirably from 1,000 to 30,000. In those cases where it is less than 500 the chipping resistance performance declines, and in those cases where it exceeds 50,000 flow properties are not obtained when baking and the finished appearance declines.

The water dispersible type or water-soluble polyester resin which can be included in the aqueous first base-paint in this invention can be obtained easily by means of a known esterification reaction from the polyhydric alcohols and polybasic acids, and oils and fats as required, from which a polyester resin is generally constituted as the resin raw materials.

Ethylene glycol, propylene glycol, 1,3-butylene glycol, 1,4-butandiol, 1,6-hexanediol, diethylene glycol, dipropylene glycol, neopentyl glycol, triethylene glycol, hydrogenated bisphenol A, glycerine, trimethylolethane, trimethylolpropane, pentaerythritol, dipentaerythritol and the like can be cited as examples of the aforementioned polyhydric alcohols. Each of these polyhydric alcohols may be used individually, or two or more types may be combined.

Furthermore, low molecular weight dicarboxylic acids which have from 2 to 30 carbon atoms in the molecule, or anhydrides thereof, are preferred as the polybasic acids, and the low molecular weight dicarboxylic acids which have from 4 to 18 carbon atoms are more desirable. Examples include o-phthalic acid, isophthalic acid, terephthalic acid, tetrahydrophthalic acid, cyclohexanedicarboxylic acid, succinic acid, adipic acid, azeleic acid, sebacic acid, maleic acid, fumaric acid, glutaric acid, hexachlorobutanedicarboxylic acid, tetrachlorophthalic acid and the like. Each of these polybasic acids may be used individually, or two or more types may be combined.

Examples of the oils and fats include soy bean oil, palm oil, safflower oil, rice bran oil, castor oil, tung oil, linseed oil, tall oil and the fatty acids obtained therefrom.

The hydroxyl group value of said hydroxyl group containing polyester resin is preferably from 10 to 150 mgKOH/g and more desirably from 20 to 130 mgKOH/g. In those cases where it is less than 10 mgKOH/g the emulsion stability of the resin in an aqueous medium is reduced, and in those cases where it exceeds 150 mgKOH/g the water resistance of the paint film is reduced.

Furthermore, the acid value of said hydroxyl group containing polyester resin is preferably from 20 to 50 mgKOH/g and more desirably from 30 to 40 mgKOH/g. In those cases where it is less than 20 mgKOH/g the emulsion stability of the resin in an aqueous medium is reduced, and in those cases where it exceeds 50 mgKOH/g the water resistance of the paint film is reduced.

Some or all of the carboxyl groups are neutralized with a basic substance so that the hydroxyl group containing polyester resin is present in a stable manner in water. The basic substance may be the same as that used with the hydroxyl group containing nonionic resin, or a different one can be used. Furthermore, the number average molecular weight of the hydroxyl group containing polyurethane resin is preferably from 500 to 50,000 and more desirably from 1,000 to 30,000. In those cases where it is less than 500 the chipping resistance performance declines, and in those cases where it exceeds 50,000 flow properties are not obtained when baking and the finished appearance declines.

Amino resins, blocked polyisocyanate compounds and the like, for example, can be cited as crosslinking agents which can be used in the aqueous first base-paint.

The methylolated amino resins obtained by a condensation reaction with formaldehyde of some or all of the amino groups of melamine, urea, benzoguanamine and the like, and alkyl-etherified amino resins where some or all of the methylol groups of said methylolated resins have been etherified with one type, or two or more types, of alcohol selected from among the mono-alcohols such as methanol, ethanol, propanol, butanol and the like, for example, can be cited as amino resins.

Examples of the blocked polyisocyanate compounds include those where the isocyanate groups of aliphatic, aromatic or alicyclic polyisocyanate compounds which have isocyanate groups have been blocked with an alcohol such as butanol and the like, an oxime such as methyl ethyl ketoxime and the like, a lactam such as e-caprolactam and the like, a diketone such as diethyl acetoacetate and the like, an imidazole such as imidazole, 2-ethylimidazole and the like, or a phenol such as m-cresol and the like.

Furthermore, both hydrophilic and hydrophobic crosslinking agents can be used.

One type of crosslinking agent alone can be used or a combination of two or more types can be used conjointly.

The amount of crosslinking agent compounded in this invention as a solid fraction mass ratio of hydroxyl group containing resin and crosslinking agent is preferably from 40/60 to 80/20, and more desirable from 50/50 to 70/30. In those cases where the amount of crosslinking agent compounded is less than 20 mass % with respect to the total mass of hydroxyl group containing resin and crosslinking agent a fall in water resistance arises, while on the other hand in those cases where it exceeds 60 mass % with respect to the total mass of hydroxyl group containing resin and crosslinking agent the chipping resistance falls.

Together with the abovementioned resins and crosslinking agents, one or more of the various pigments such as the inorganic pigments, organic pigments, aluminum pigments, pearl pigments, true pigments and the like, various additives such as surface controlling agents, anti-foaming agents, surfactants, film-formation promotors, preservatives, ultraviolet absorbers, photo-stabilizers, antioxidants and the like, various rheology controlling agents and various types of organic solvent which are known in the paint industry may be included in the aqueous first base-paint in this invention.

The water content in the aqueous first base-paint should be the amount required so that the viscosity of the paint is set within a suitable range, and generally the amount of water included in the whole of the solvent is preferably from 50 to 90 mass % and more desirably from 60 to 80 mass.

The aqueous second base-paint in this invention may contain, together with one or more type of base resin selected from among polyurethane resin, acrylic emulsion, acrylic urethane resin and the like and one or more type of crosslinking agent selected from among amino resin, blocked polyisocyanate compound and the like, one or more of the various pigments such as the inorganic pigments, organic pigments, aluminum pigments, pearl pigments, true pigments and the like, various additives such as surface controlling agents, anti-foaming agents, surfactants, film-formation promotors, preservatives, ultraviolet absorbers, photo-stabilizers, antioxidants and the like, various rheology controlling agents and various types of organic solvent which are known in the paint industry.

The water content in the aqueous second base-paint should be the amount required so that the viscosity of the paint is set within a suitable range, and generally the amount of water included in the whole of the solvent is preferably from 50 to 90 mass %, and more desirably from 60 to 80 mass.

Furthermore, all types of paint, such as the aqueous type, organic solvent type, powder type and the like, can be used for the clear paint which is painted over the second base-paint layer, but the organic solvent types are especially desirable. The melamine crosslinking type, acid/epoxy crosslinking type, isocyanate crosslinking type, blocked isocyanate crosslinking type and combinations thereof can be cited as examples of the hardening system of the clear paint.

The method of painting in this invention is a method of forming a multi-layer paint film in which an aqueous first base-paint is painted on a base material on which an electro-deposition paint has been painted and a first base-paint layer is formed, a second base-coat paint is applied on said first base-paint layer with a wet-on-wet system and a second base-paint layer is formed and then a clear paint is applied over the second base-paint layer with a wet-on-wet system and a clear-paint layer is formed and then the three paint layers are baked at the same time.

Various types of electro-deposition paint can be cited for the electro-deposition paint which is used on the base material on which an electro-deposition paint has been painted, but a cationic electro-deposition paint is preferred.

The base material is preferably a metal, and more desirably it is a pre-surface treated metal. The electro-deposition paint layer which has been painted on the base material is preferably baked and hardened. The baking temperature is preferably from 100 to 200° C., and the baking time is preferably from 10 to 50 minutes.

In this invention a wet-on-wet system signifies applying an upper-coat paint in a state where the underlying paint layer has not been baked.

Moreover, a preliminary drying process with a flash-off process may be imposed after coating the aqueous first base-coat paint and after coating the aqueous second base-coat paint. The preliminary drying temperature generally is preferably from 30 to 100° C.

Furthermore, a painting process which is generally carried out in a normal three-coat two-bake painting process with a chipping primer or an undercoat primer can be carried out before the aqueous first base-paint painting process.

The method of applying the abovementioned paints can be executed with various painting methods and, for example, it may be a spray-painting method such as with an air sprayer, electro-static air sprayer, airless sprayer or the like, a painting method in which a painting machine as generally used with a roll coater, flow coater or of the dipping type is used, or a painting method in which a brush, bar coater, applicator or the like is used. Of these the spray-painting methods are preferred.

No particular limitation is imposed upon the painting temperature in this invention, but generally it is preferably carried out within the range from 10 to 40° C.

The film thickness of each paint layer after baking in this invention is preferably from 5 to 35 μm for the aqueous first base-paint film, preferably from 5 to 30 μm for the second base-paint film and from 30 to 50 μm for the clear paint film.

Furthermore, the baking temperature is preferably from 100° C. to 170° C., and the baking time is preferably from 20 to 40 minutes.

The invention is described in more detail below by means of illustrative examples. Moreover, "parts" and "%" signify "parts by mass" and "mass %". Furthermore, the units of the amount of each component compounded shown in Tables 1 to 4 are parts by mass.

<Production of Hydroxyl Group Containing Nonionic Resin which has a Polyester Resin Skeleton Solution A-1>

Lauric acid (10 parts), 30 parts of phthalic acid anhydride, 5 parts of adipic acid, 29.2 parts of neopentyl glycol, 10.8 parts of trimethylolpropane and 5 parts of Uniox M1000 (trade name, polyethylene glycol mono-methyl ether produced by the Nippon Yushi Co., number average molecular weight 1,000) were introduced into a reaction vessel which had been furnished with a reflux condenser which was equipped with a separating tube for the water produced by the reaction, nitrogen gas delivery apparatus, a thermometer and stirring apparatus and mixed together and the mixture obtained was heated to 120° C. to form a solution, after which the temperature was raised to 160° C., with stirring. After being maintained at 160° C. for 1 hour the temperature was gradually raised, and the temperature was raised to 230° C. over a period of 5 hours. Next, after maintaining the temperature at 230° C. and continuing the reaction for 2 hours, the temperature was dropped to 180° C., 10 parts of trimellitic acid anhydride were introduced and the reaction was continued and the reaction was completed and the mixture was cooled when the acid value reached 13 mgKOH/g. After cooling to below 80° C., 25 parts of butylcellosolve and then 1.7 parts of dimethylethanolamine were added and neutralization of the resin was carried out, after which de-ionized water was added and hydroxyl group containing nonionic resin solution A-1 of involatile fraction 30%, hydroxyl group value 90 mgKOH/g, acid value 13 mgKOH/g and number average molecular weight 2,000 was obtained. The formulation is shown in Table 1.

<Production of Hydroxyl Group Containing Nonionic Resin which has a Polyester Resin Skeleton Solutions A-2 to A-5>

The hydroxyl group containing nonionic resin solutions A-2 to A-5 were produced in the same way as hydroxyl group containing nonionic resin solution A-1 except that the raw materials were switched as shown in Table 1 and the acid value at the end of the reaction was switched as shown in Table 1. The characteristic values of the resin solutions are shown in Table 1.

TABLE 1

| | Hydroxyl group containing nonionic resin solution number | | | | |
|---|---|---|---|---|---|
| | A-1 | A-2 | A-3 | A-4 | A-5 |
| Lauric acid | 10 | 10 | 10 | 10 | 10 |
| Phthalic acid anhydride | 30 | 30 | 30 | 25 | 30 |
| Adipic acid | 5 | 0.4 | 5.2 | 2.1 | 8.6 |
| Neopentyl glycol | 29.2 | 28.2 | 28.6 | 24.7 | 28.7 |
| Trimethylolpropane | 10.8 | 9.4 | 11.2 | 10.2 | 12.7 |
| Uniox M1000 | 5 | 12 | 5 | 18 | |
| Trimellitic acid anhydride | 10 | 10 | 10 | 10 | 10 |
| Sub-total | 100 | 100 | 100 | 100 | 100 |
| (Amount of dewatering during polyester synthesis) | 7.3 | 6.5 | 7.3 | 6.3 | 7.8 |
| Butylcellosolve | 25 | 25 | 25 | 25 | 25 |
| Dimethylethanolamine | 1.7 | 0.25 | 1.9 | 0.25 | 3.2 |
| De-ionized water | 189.6 | 193 | 189.5 | 193.4 | 186.9 |
| Total | 309.0 | 311.8 | 309.2 | 312.4 | 307.3 |
| Resin solid fraction (mass %) | 30 | 30 | 30 | 30 | 30 |
| Number average molecular weight | 2,000 | 2,000 | 2,000 | 2,000 | 2,000 |
| Hydroxyl group value (mgKOH/g) | 90 | 90 | 90 | 90 | 90 |
| Resin acid value (mgKOH/g) | 13 | 2 | 17 | 2 | 25 |
| Ethylene oxide unit content (mass %) | 5.4 | 12.8 | 5.4 | 19.2 | 0 |

<Production of Polyester Resin Solution P-1>

Lauric acid (10 parts), 30 parts of phthalic acid anhydride, 18.3 parts of adipic acid, 34.6 parts of neopentyl glycol and 7.1 parts of trimethylolpropane were introduced into a reaction vessel which had been furnished with reflux condenser which was equipped with a separating tube for the water produced by the reaction, nitrogen gas delivery apparatus, a thermometer and stirring apparatus and mixed together and the mixture obtained was heated to 120° C. to form a solution, after which the temperature was raised to 160° C., with stirring. After being maintained at 160° C. for 1 hour, the temperature was gradually raised, and the temperature was raised to 230° C. over a period of 5 hours. Then the temperature was maintained at 230° C. and the reaction was continued and the reaction was terminated and the mixture was cooled when the acid value reached 2 mgKOH/g. After cooling to below 80° C., 22.8 parts of toluene were added and hydroxyl group containing polyester resin solution P-1 of involatile fraction 80%, hydroxyl group value 75 mgKOH/g, acid value 2 mgKOH/g and number average molecular weight 1,500 was obtained.

<Production of Hydroxyl Group Containing Nonionic Resin which has a Polyurethane Resin Skeleton Solution A-6>

The polyester resin solution P-1 (79.2 parts), 3 parts of dimethylopropionic acid, 22.7 parts of isophorone diisocyanate, 0.1 part of trimethylolpropane, 5 parts of Yuniol D1000 (trade name, polypropylene glycol, produced by the Nippon Yushi Co., number average molecular weight about 1000) and 40 parts of methyl ethyl ketone were introduced into a reaction vessel which had been furnished with nitrogen gas delivery apparatus, a thermometer and stirring apparatus and mixed together, reacted at 80° C., with stirring, and then when the isocyanate value reached 0.67 meq/g 5.9 parts of diethanolamine were added and reaction was continued at 80° C. and then when the isocyanate value reached 0.01 equ/g 40 parts of butylcellosolve were added and the reaction was terminated. Subsequently, the toluene and methyl ethyl ketone were distilled off at 100° C. under reduced pressure and then the mixture was cooled to 50° C., 1.8 parts of dimethylethanolamine were added and neutralization of the resin was carried out, and then de-ionized water was added and hydroxyl group containing nonionic resin solution A-6 of involatile fraction 25%, hydroxyl group value 63 mgKOH/g, acid value 14 mgKOH/g and number average, molecular weight 4,000 was obtained. The formulation is shown in Table 2.

TABLE 2

| | Hydroxyl group containing nonionic resin solution number | | | | |
|---|---|---|---|---|---|
| | A-6 | A-7 | A-8 | A-9 | A-10 |
| Polyester resin varnish P-1 *1 | 79.2 | 75.7 | 78 | 70.8 | 81.8 |
| Dimethylopropionic acid | 3 | 0.2 | 3 | 0.2 | 4.7 |
| Isophorone diisocyanate | 22.7 | 19.4 | 23.2 | 19.4 | 24.2 |
| Trimethylolpropane | 0.1 | | | | |
| Yuniol D1000 | 5 | 14 | | 18 | |
| Yuniox M1000 | | | 5 | | |
| Methyl ethyl ketone *2 | (40) | (40) | (40) | (40) | (40) |
| Diethanolamine *3 | 5.9 | 5.8 | 5.8 | 5.7 | 5.7 |
| Butylcellosolve | 40 | 40 | 40 | 40 | 40 |
| Dimethylethanolamine *4 | 1.8 | 0.3 | 1.8 | 0.3 | 2.6 |
| De-ionized water | 258.4 | 259.6 | 256.4 | 259.5 | 257.5 |
| Total | 400.3 | 399.3 | 397.6 | 399.7 | 400.1 |
| Resin solid fraction (mass %) | 25 | 25 | 25 | 25 | 25 |
| Number average molecular weight | 4,000 | 4,000 | 4,000 | 4,000 | 4,000 |
| Hydroxyl group value (mgKOH/g) | 63 | 62 | 62 | 62 | 62 |
| Acid value (mgKOH/g) | 14 | 2 | 14 | 2 | 21 |
| Propylene oxide unit content (mass %) | 5 | 14 | | 18 | |
| Ethylene oxide unit content (mass %) | | | 5 | | |

Notes for Table 2

*1: The solvent in the polyester resin P-1 was distilled off under reduced pressure and so it is not included in the total.

*2: The methyl ethyl ketone was also distilled off under reduced pressure and so it is not included in the total.

*3: Diethanolamine is an amine which was reacted with isocyanate and it is included in the resin solid fraction.

*4: Dimethylethanolamine is an amine which was used as a neutralizing agent and it is not included in the resin solid fraction.

<Production of Hydroxyl Group Containing Nonionic Resin with a Polyurethane Skeleton Solutions A-7 to A-10>

Nonionic resin solutions A-7 to A-10 were produced in the same way as nonionic resin solution A-6, except that the raw materials were switched as shown in Table 2. The characteristic values of the resin solutions are shown in Table 2.

<Examples of Aqueous First Base-Paint Production 1 to 13>

The aqueous first base-paints B-1 to B-13 were prepared with the compounding proportions shown in Tables 3 and 4.

For the aqueous first base-paints, the titanium dioxide R706 (trade name, produced by the DuPont Co.), carbon black MA-100 (produced by the Mitsubishi Kagaku Co.) and true pigment Barium Sulfate B34 (trade name, produced by the Sakai Kagaku Co.) were added to the hydroxyl group containing nonionic resin solution with the compounding proportions shown in Table 3 and Table 4 and dispersed in a disperser and then the melamine resin Cymel 327 (trade name, produced by the Cytech Co., solid fraction 90 mass %) or blocked polyisocyanate Bayhydur VPLS2310 (trade name, produced by the Sumitomo Beyer Urethane Co., involatile fraction 39.5 mass %, effective NCO 3.9 mass %) was added and mixed in a disperser and the viscosity was adjusted to 40 seconds/Ford Cup No. 4 (20° C.) with de-ionized water.

TABLE 3

| | | Aqueous First Base-paint No. | | | | | | | |
|---|---|---|---|---|---|---|---|---|---|
| | | B-1 | B-2 | B-3 | B-4 | B-5 | B-6 | B-7 | B-8 |
| Hydroxyl group containing nonionic resin solution | A-1 | 233 | | | | | | | 200 |
| " | A-2 | | 233 | 140 | | | | | |
| " | A-3 | | | | | | | | |
| " | A-4 | | | | | | | | |
| " | A-5 | | | 93 | | | | | |
| " | A-6 | | | | 280 | | | | |
| " | A-7 | | | | | 280 | | | |
| " | A-8 | | | | | | 280 | 168 | |
| " | A-9 | | | | | | | | |
| " | A-10 | | | | | | | 112 | |
| Bayhydur VPLS2310 | | | | | | | | | 101 |
| Cymel 327 | | 33.3 | 33.3 | 33.3 | 33.3 | 33.3 | 33.3 | 33.3 | |
| Titanium dioxide | | 5 | 5 | 5 | 5 | 5 | 5 | 5 | 5 |
| True pigment | | 55 | 55 | 55 | 55 | 55 | 55 | 55 | 55 |
| Carbon black | | 4 | 4 | 4 | 4 | 4 | 4 | 4 | 4 |
| Total | | 330.0 | 330.0 | 330.0 | 377.3 | 377.3 | 377.3 | 377.3 | 365 |
| Hydroxyl group containing resin/crosslinking agent solid fraction mass ratio | | 70/30 | 70/30 | 70/30 | 70/30 | 70/30 | 70/30 | 70/30 | 60/40 |
| Hydroxyl group containing nonionic resin/other hydroxyl group containing resin solid fraction mass ratio | | 100/0 | 100/0 | 60/40 | 100/0 | 100/0 | 100/0 | 60/40 | 100/0 |

TABLE 4

| | | Aqueous First Base-paint No. | | | | |
|---|---|---|---|---|---|---|
| | | B-9 | B-10 | B-11 | B-12 | B-13 |
| Hydroxyl group containing nonionic resin solution | A-1 | | | | | |
| " | A-2 | | | 93 | | |
| " | A-3 | 233 | | | | |
| " | A-4 | | 233 | | | |
| " | A-5 | | | 140 | | |
| " | A-6 | | | | | |
| " | A-7 | | | | | |
| " | A-8 | | | | | 112 |
| " | A-9 | | | | 280 | |
| " | A-10 | | | | | 168 |
| Cymel 327 | | 33.3 | 33.3 | 33.3 | 33.3 | 33.3 |
| Titanium dioxide | | 5 | 5 | 5 | 5 | 5 |
| True pigment | | 55 | 55 | 55 | 55 | 55 |
| Carbon black | | 4 | 4 | 4 | 4 | 4 |
| Total | | 330.3 | 330.3 | 330.3 | 377.3 | 377.3 |
| Hydroxyl group containing resin/crosslinking agent solid fraction mass ratio | | 70/30 | 70/30 | 70/30 | 70/30 | 70/30 |
| Hydroxyl group containing nonionic resin/other hydroxyl group containing resin solid fraction mass ratio | | 100/0 | 100/0 | 40/60 | 100/0 | 40/60 |

EXAMPLE 1

Treatment of a dull steel sheet for automobile purposes (JIS G3142) with the zinc phosphate treatment agent Bondelite No. 3004, (trade name, produced by the Nihon Parkerizing Co.) was carried out and then the electro-deposition paint CathoGuard 500 (trade name, produced by the BASF Coatings Japan Co.) was electro-deposition painted on in such a way that the dry film thickness was 20 μm and baked and hardened for 20 minutes at 175° C.

The aqueous first base-paint B-1 was painted on the electro-deposition painted steel sheet with a Bell Rotation type electrostatic painting machine in such a way that the hardened film thickness was from 15 to 20 μm and, after being left to stand for 5 minutes in the booth, the aqueous second base-paint Aqua BC-3 Black (trade name, produced by the BASF Coatings Japan Co., polyurethane/polyester/melamin resin based) was painted on with a Bell Rotation type electrostatic painting machine in such a way that the hardened film thickness was from 12 to 15 μm and, after being left to stand for 5 minutes in the booth it was heated to 80° C. for 3 minutes and then the clear paint Belcoat ES-3 Clear (trade name, produced by the BASF Coatings Japan Co.) was painted on with a Bell Rotation type electrostatic painting machine in such a way that the hardened film thickness was from 35 to 40 μm and, after being left to stand for 10 minutes in the booth, it was baked and hardened for 30 minutes at 140° C. to prepare a painted sheet for paint film testing purposes. Moreover, the painting was carried out under conditions of booth temperature 25° C./booth humidity 75%.

The multi-layer paint film obtained by means of the above-mentioned process was subjected to a paint film performance evaluation using the methods outlined below. The results of the evaluation are shown in Table 5.

EXAMPLES 2 TO 7 AND COMPARATIVE EXAMPLES 1 TO 5

Painted sheets for paint film testing purposes were prepared in essentially the same way as in Example 1 except that the aqueous first base-paint B-1 was switched to the aqueous first base-paint shown in Table 5, and the evaluation results are shown in Table 5.

<Methods of Evaluation>

The paint film appearance, water resistance and chipping resistance were evaluated with the methods indicated below.

Evaluation of Paint Film Appearance

The short-wave value (SW value) and the long-wave value (LW value) were measured with a wave scanner DOI produced by the BYK Co. The smaller the numerical value the better the appearance, and an SW of not more than 10 and an LW of not more than 3 are the pass levels.

Evaluation of Water Resistance

The test painted sheet was immersed in warm water at 40° C. for 10 days and then the state of the paint film surface was evaluated visually.

Evaluation of Chipping Resistance

The test painted sheet was set at an angle of 45° in a Gravelometer (produced by the Suga Shikenki Co.) in an environment at −20° C. and 50 g of No. 7 broken stone was jetted out, at an air pressure of 4 kg/cm$^2$ and made to collide with the paint film surface, and the area of paint film which had been peeled away was evaluated. The smaller the numerical value the better, and not more than 1.0 is the pass level.

TABLE 5

| | Example | | | | | | | | Comparative Example | | | | |
|---|---|---|---|---|---|---|---|---|---|---|---|---|---|
| | 1 | 2 | 3 | 4 | 5 | 6 | 7 | 8 | 1 | 2 | 3 | 4 | 5 |
| Aqueous First Base-paint No. | B-1 | B-2 | B-3 | B-4 | B-5 | B-6 | B-7 | B-8 | B-9 | B-10 | B-11 | B-12 | B-13 |
| Appearance, SW Value | 9 | 9 | 10 | 10 | 9 | 10 | 10 | 10 | 18 | 9 | 20 | 9 | 20 |
| Appearance, LW Value | 3 | 3 | 3 | 3 | 3 | 3 | 3 | 3 | 4 | 3 | 5 | 3 | 5 |
| Water Resistance | ○ | ○ | ○ | ○ | ○ | ○ | ○ | ○ | ○ | Shrunken Skin | ○ | Shrunken Skin | ○ |
| Chipping Resistance | 0.8 | 0.9 | 1.0 | 1.0 | 1.0 | 0.9 | 1.0 | 1.0 | 1.0 | 1.0 | 1.2 | 0.8 | 0.9 |

As is clear from Table 5, a paint film which has an excellent finished appearance, water resistance and chipping resistance can be obtained with the method of forming a multi-layer paint film of this invention.

The invention claimed is:

1. A method of forming a multi-layer paint film, comprising painting an aqueous first base-paint on a base material on which an electro-deposition paint has been coated in order to form a first base-paint layer, painting an aqueous second base-paint on said first base-paint layer as a wet-on-wet system in order to form a second base-paint layer, painting a clear-paint on the second base-paint layer as a wet-on-wet system in order to form a clear-paint layer, and baking the three paint layers at the same time, wherein the aqueous first base-paint comprises a hydroxyl group containing non-ionic resin and a crosslinking agent, wherein the hydroxyl group containing non-ionic resin comprises at least one of ethylene oxide units, propylene oxide units, and the combination thereof, in an amount of from 4 to 15 mass % in the hydroxyl group containing non-ionic resin and has a resin acid value of less than 15 mgKOH/g and a hydroxyl group value of from 10 to 100 mgKOH/g.

2. The method of claim 1 in which the aqueous first base-paint further comprises at least one of a hydroxyl group containing polyurethane resin, a hydroxyl group containing polyester resin and the combination thereof, in a proportion of less than 50 mass % with respect to the total solid fraction of hydroxyl group containing resin including said hydroxyl group containing nonionic resin.

3. The method of claim 2 wherein the hydroxyl group containing polyurethane resin comprises a water-dispersible resin having a hydroxyl group value from 10 to 100 mgKOH/g.

4. The method of claim 2 in which the hydroxyl group containing polyester resin comprises a water-dispersible or water-soluble resin having a hydroxyl group value from 10 to 150 mgKOH/g and an acid value from 20 to 50 mgKOH/g.

5. The method of claim 1 wherein the crosslinking agent is at least one of a melamine resin, a blocked isocyanate compound, and the combination thereof, and the solid fraction mass ratio of the hydroxyl group containing non-ionic resin and the crosslinking agent is from 40/60 to 80/20.

* * * * *